US012569070B2

(12) United States Patent
Miller

(10) Patent No.: US 12,569,070 B2
(45) Date of Patent: Mar. 10, 2026

(54) HEXAGONAL BED STRUCTURE

(71) Applicant: Garry Marc Miller, Los Angeles, CA (US)

(72) Inventor: Garry Marc Miller, Los Angeles, CA (US)

(73) Assignee: Garry Marc Miller, Los Angeles, CA (US)

( * ) Notice: Subject to any disclaimer, the term of this patent is extended or adjusted under 35 U.S.C. 154(b) by 12 days.

(21) Appl. No.: 18/445,805

(22) Filed: Feb. 13, 2024

(65) Prior Publication Data

US 2025/0040722 A1 Feb. 6, 2025

Related U.S. Application Data

(60) Provisional application No. 63/628,534, filed on Jul. 31, 2023, provisional application No. 63/628,532, filed on Jul. 31, 2023.

(51) Int. Cl.
*A47C 19/02* (2006.01)
*A47C 19/22* (2006.01)

(52) U.S. Cl.
CPC ..... *A47C 19/022* (2013.01); *A47C 19/22* (2013.01)

(58) Field of Classification Search
CPC ..... A47C 17/86
USPC ..... 5/907
See application file for complete search history.

(56) References Cited

U.S. PATENT DOCUMENTS

| | | | | |
|---|---|---|---|---|
| 7,546,648 | B2 * | 6/2009 | Steffes | A47D 7/002 5/907 |
| 10,413,062 | B2 * | 9/2019 | Miller | F24C 7/004 |
| 2005/0034233 | A1 * | 2/2005 | Gladney | A47C 17/86 5/907 |
| 2011/0000020 | A1 * | 1/2011 | Walvius | D04B 9/42 112/475.08 |

FOREIGN PATENT DOCUMENTS

| | | | | |
|---|---|---|---|---|
| CN | 116570122 A | * | 8/2023 | A47C 19/22 |
| DE | 202010000725 U1 | * | 4/2010 | A47C 19/02 |
| JP | 2017209321 A | * | 11/2017 | A47C 19/005 |
| KR | 20170129309 A | * | 11/2017 | A47C 17/86 |

* cited by examiner

*Primary Examiner* — Eric J Kurilla
(74) *Attorney, Agent, or Firm* — Bhasin Law, a Professional Corporation

(57) ABSTRACT

In some implementations, a hexagonal bed structure include static furniture pieces affixed and supported by one or more support structures. The static furniture pieces backs and affix to the support structure. The bottom surface of the mattress position on the top surfaces of the static furniture pieces and the support structure. At the forward side end portion of the hexagonal bed structure defines a storage space and dynamic furniture pieces substantially reside in the storage space when the hexagonal bed structure is dressed in bedclothes and in a closed configuration.

12 Claims, 5 Drawing Sheets

HEXAGONAL BED STRUCTURE

TECHNICAL FIELD

This disclosure relates to saving more bedroom space.

BACKGROUND

Bedrooms have a limited amount of space to contain furniture. However, rectangular bed shapes can take up substantial space even when not in use. Other bed structures can be designed to save and utilize more bedroom space.

SUMMARY

The details of one or more embodiments of the invention are set forth in the accompanying drawings and the description below. Other features, objects, and advantages of the invention will be apparent from the description and drawings, and from the claims.

Figure 1:
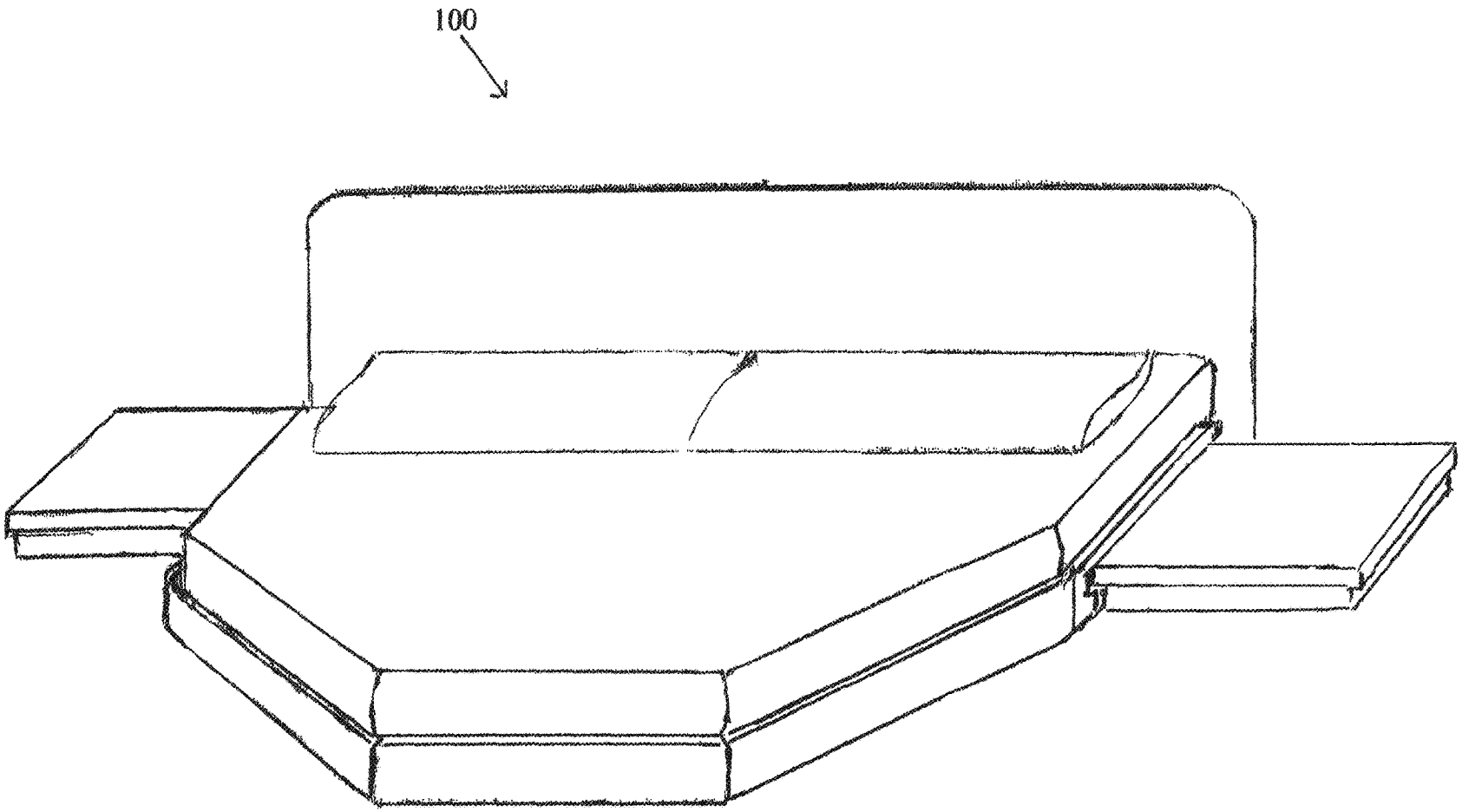
FIG. 1 is an example hexagonal bed structure in accordance with some implementations of the present disclosure.
Figure 2:
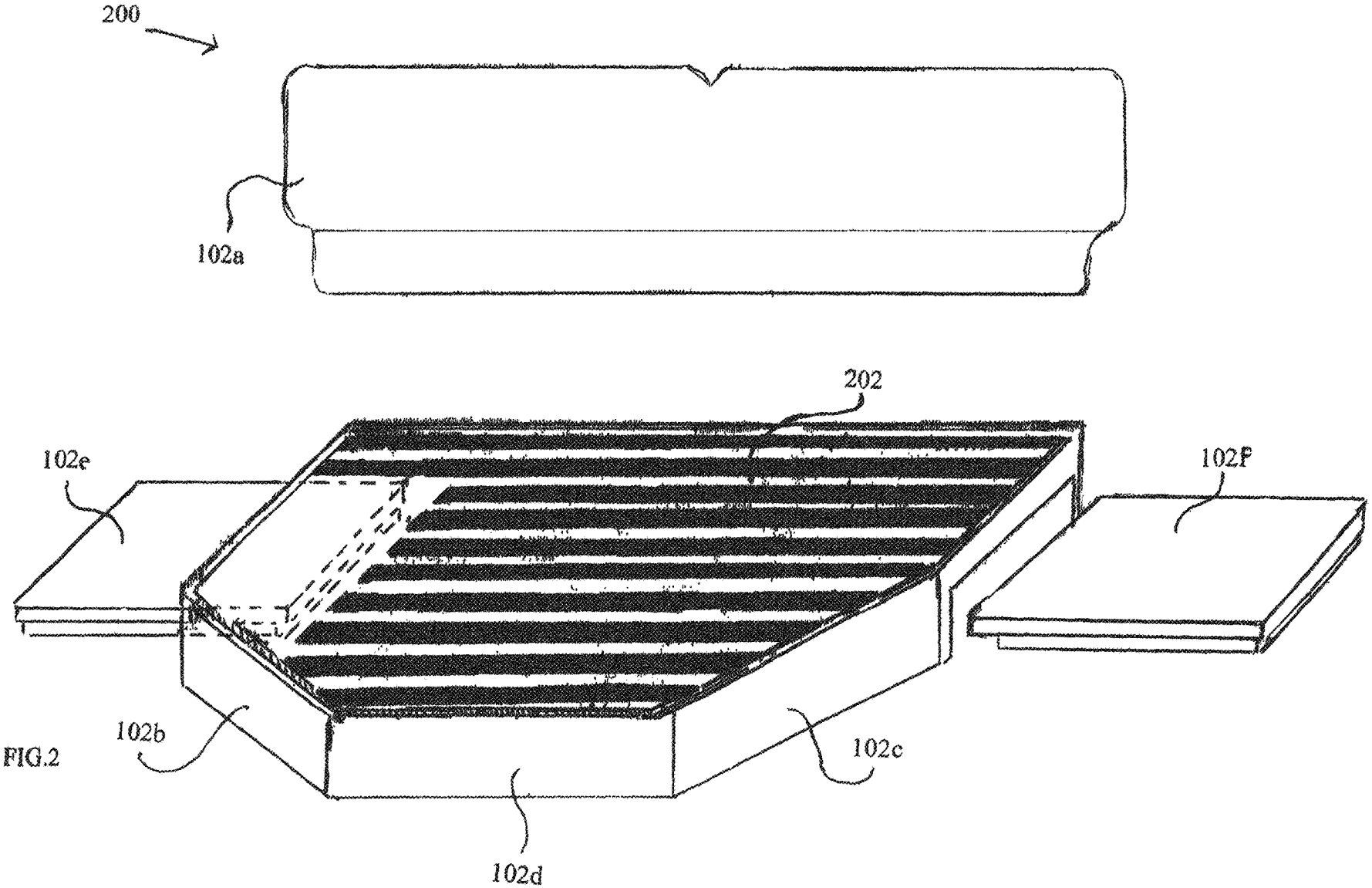

The FIG. 2 is an example of the support structure materials for the example hexagonal bed structure.

Figure 3:
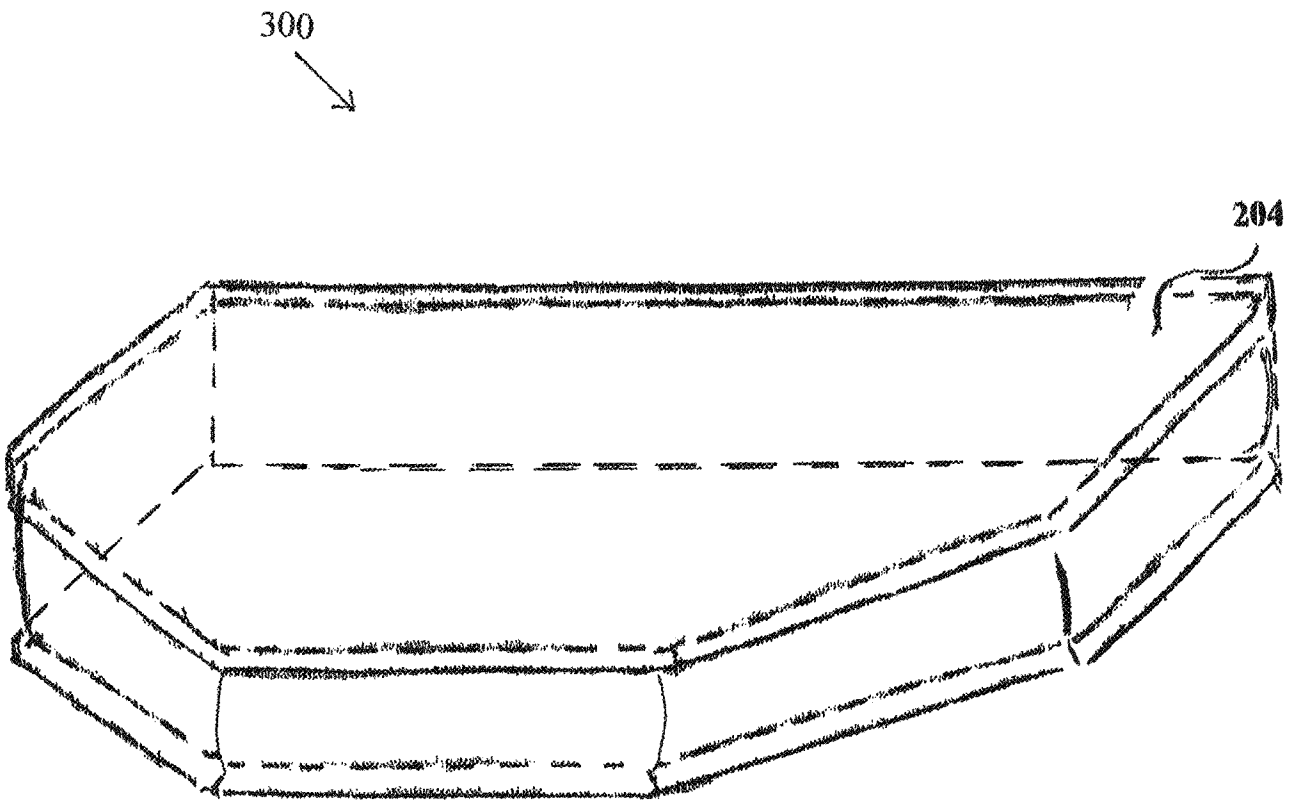

FIG. 3 is an example mattress for the example hexagonal bed structure.

Figure 4:
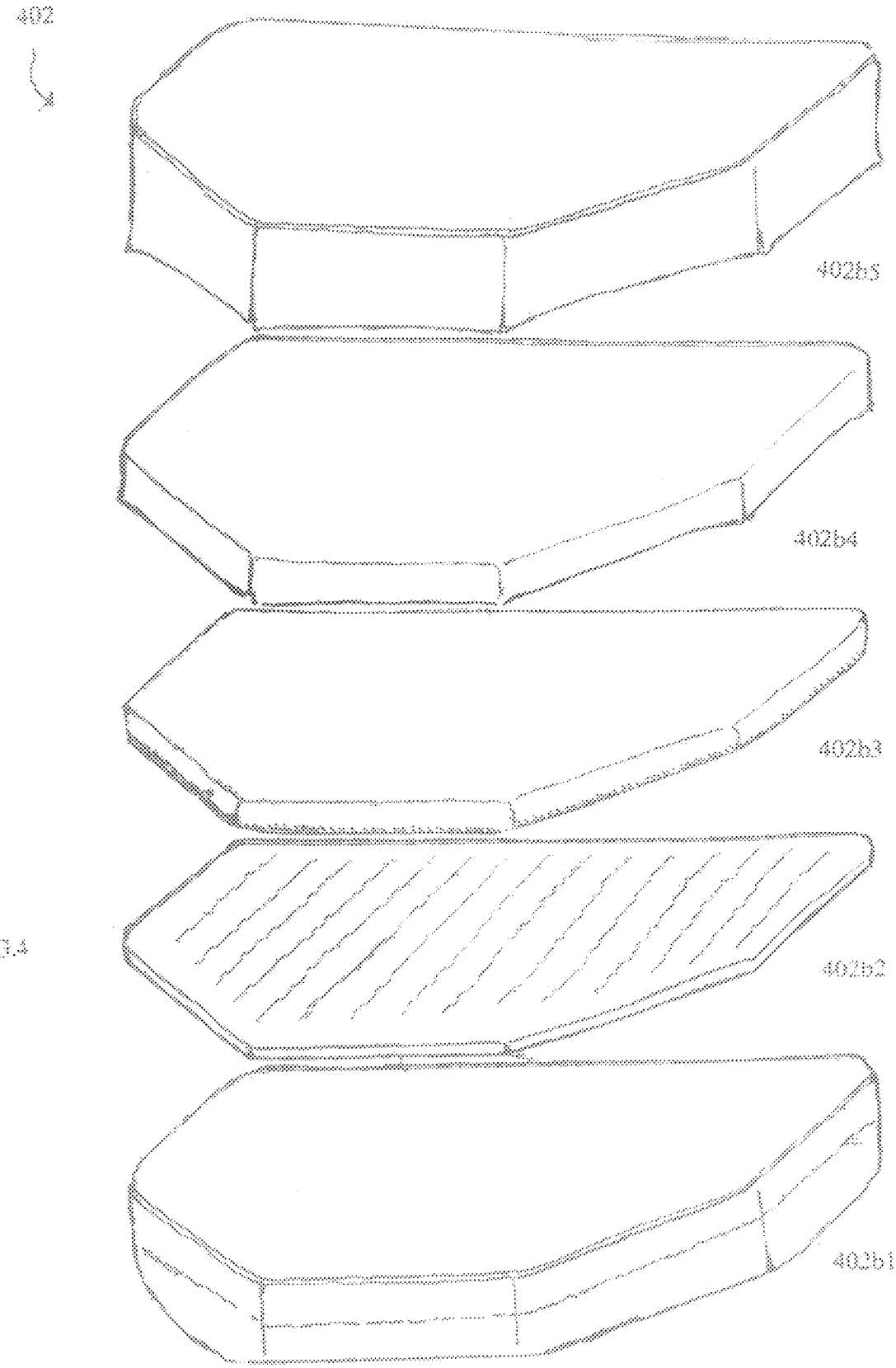

FIG. 4 is an example bedclothes for the mattress for the example hexagonal bed structure.

Figure 5:
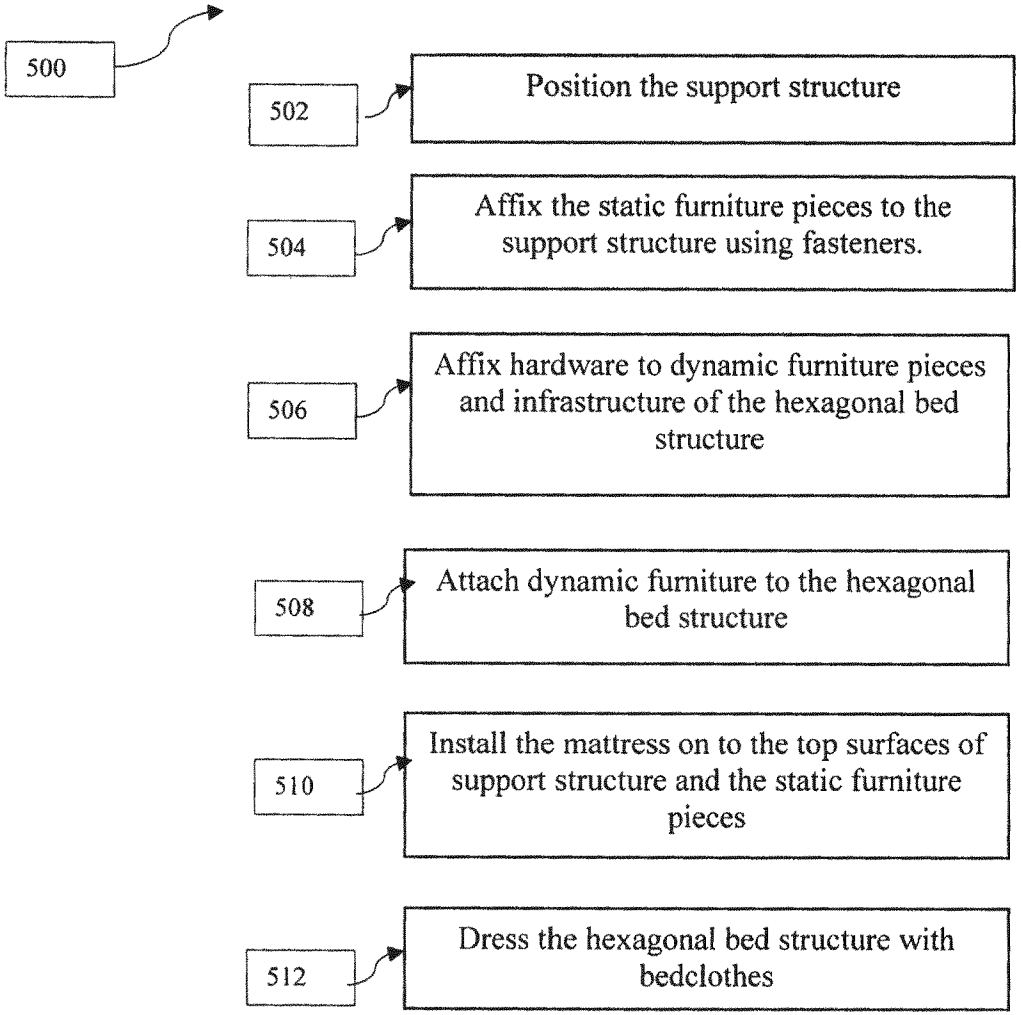

FIG. 5 is a flowchart illustrating an example method for constructing a hexagonal bed structure.

Like reference symbols in the various drawings indicate like elements.

DETAILED DESCRIPTION

The present disclosure is directed to a hexagonal bed structure 100 for saving and utilizing more bedroom space. For example, the hexagonal bed structure 100 may incorporate a plurality of static furniture pieces 102 *a-d* and dynamic furniture pieces 102 *e* and 102 *f* (FIG. 2). The furniture pieces 102 *a-d* (FIG. 2) will construct the bed frame for the hexagonal bed structure 100 and a plurality of dynamic furniture pieces 102 *e* and 102 *f* that include at least a portion that slide in and out of the hexagonal bed structure 100 and complements the hexagonal bed structure.

As illustrated in FIG. 2, the plurality of static furniture pieces 102 *a-d* includes at least one headboard 102 *a*, a left diagonal side panel 102 *b*, a right diagonal side panel 102 *c*, a foot-end panel 102 *d*, and a plurality of dynamic furniture pieces includes a left bedside component 102 *e*, and a right bedside component 102*f*. Other hexagonal bed structure 100 can all, some, or none of the illustrated static furniture pieces 102 *a-d* and dynamic furniture pieces 102 *e* and 102 *f* without departing from the scope of the disclosure. The plurality of static furniture pieces 102 *a-d* is affix to each other and to the hexagonal support structure 202 using one or more fasteners. The fasteners can include joiners and screws, or other fasteners without departing from the scope of the disclosure. In regards to the arrangement, each of the static furniture pieces 102 *a-d* and the support structure 202 can include a top and a bottom surface. The top surfaces of the static furniture pieces 102 *b-d* and the support structure 202 abuts the bottom surface of the mattress 204 (FIG. 3) and the bottom surfaces of the static furniture pieces 102 *a-d* and the support structure 202 abuts the flooring, whereas the static furniture pieces 102 *a-d* have also created an open cavity space for the support structure 202. The hexagonal bed structure 100 may include other elements between the surfaces without departing from the scope of the disclosure. In regard to the static furniture pieces 102 *b* and *c* affixed on the back portion of each static furniture piece 102 *a-d*. At the forward side panel of static furniture pieces 102 *b-c* are open cavities spaces that are defined as storage spaces. As illustrated, the storage spaces are substantially rectangular and be other shapes without departing from the scope of the disclosure. The plurality of dynamic furniture pieces 102 *e* and 102 *f* comprise at least a left bedside component 102 *e* and a right bedside component 102 *f* that are movable within the storage spaces. The hexagonal bed structure 100 can include some, none, or all of the dynamic pieces without departing from the scope of the disclosure. Both bedside components 102 *e* and 102 *f* move in a plane parallel to the bedroom flooring. As a result, the bedside components 102 *e* and 102 *f* can move in and out of the storage spaces. When extended out of the storage spaces, the bedside components 102 *e* and 102 *f* are usable as bedside components respectively. When not in use, the bedside components 102 *e* and 102 *f* can slide into the storage spaces. When retracted, the bedside components 102 *e* and 102 *f* remaining portions of the remove define a same square footage defined by that room without any furniture. By using the empty space previously unused, the hexagonal bed structure 100 maintains the usable square footage when the dynamic furniture pieces 102 *e* and 102 *f* are stored. The hexagonal bed structure 100 can include tracks, rails, or elements that guide the bedside components 102 *e* and 102 *f* in and out of the storage space. The rails help to position and stabilize the bottom surface of mattress 204. The dynamic furniture pieces 102 *e* and 102 *f* can move differently relative to the hexagonal bed structure 100. For example, the bedside components 102 *e* and 102 *f* may be attached to a hinge connected within the storage space and rotate away from the hexagonal bed structure 100 about the hinge.

FIG. 2 is an expanded view 200 of the hexagonal bed structure 100. The expanded view 200 illustrates an example of the hexagonal support structure 202 for the hexagonal bed structure 100. In this implementation, the support structure 202 support and stabilize the mattress 204 and static furniture pieces. Other support-structure designs can be used without departing from the scope of the disclosure.

FIG. 3 is an expanded view 300 of the hexagonal bed structure 100. The expanded view 300 illustrates an example mattress 204 for the hexagonal bed structure 100. In this implementation, a fabric case mattress 204 is filled with resilient materials for sleeping, lying, or resting. Other mattress designs can be used without departing from the scope of the disclosure.

FIG. 4 is an expanded view of the hexagonal bed structure 100. The expanded view illustrates an example bedclothes 402 for the mattress 204 for the hexagonal bed structure 100. The bedclothes 402(*b*1-*b*5) includes at least one mattress protector 402*b*1, a mattress pad 402*b*2, a fitted sheet 402*b*3, a flat sheet 402*b*4, and a bed cover 402*b*5. In this implementation, the bedclothes 402 is the bedding that dresses the hexagonal bed structure 100. The mattress protector 402*b*1 enclose around mattress 204 to protect preserve cleanliness, and protect against odors, spills, and pests. The mattress pad 402*b*2 is filled with more resilient materials potentially for added soft comfort or to make it firmer on top of the mattress protector. The fitted sheet 402*b*3 fits over and around both 402*b*1 and 402*b*2 snuggly and provides for good body temperature regulation. Flat sheet **402*b*4 loosely fits over 402*b*3 functionally adding to said regulation either for warmth or cooler temperatures. The bed cover 402*b*5 completes the make-up and dressing of the mattress 204 of the hexagonal bed structure 100. All bedclothes are designed to fit onto the hexagonal mattress 204. Other bedclothes can be used without departing from the scope of the disclosure. Other bedclothes 402** designs can be used without departing from the scope of the disclosure.

FIG. 5 is a flowchart illustrating an example method 500 for assembling a hexagonal bed structure 100. The method 500 begins at step 502 where the support structure is positioned. For example, the support structure 202 in FIG. 2 can be positioned near, abutting a wall, or in the center of a room. At step 504, static furniture backs to and affixed to the support structure. In the example, static furniture pieces can include a sufficient number of pieces to support the embodiment of the hexagonal bed structure 100. Next, at 506, hardware is installed that guides the dynamic furniture pieces 104 along a path when moving them in and out of the storage space. The hardware can include slide-tracks, rails or other hardware. At step 508, the dynamic furniture is fixed to the installed hardware of the hexagonal bed structure. Returning to the example, hexagonal bed structure 100 can be affixed to the static furniture 102. At step 510, the mattress is installed. In this example, the bottom surface of mattress 204 abuts the top surfaces of the static furniture pieces 102 *b-d* and support structure. The top surfaces of the static furniture 102 *b-d* have border-edges that stabilize the mattress 204 in position. Other securing designs to keep the mattress in place can be used without departing from the scope of the disclosure. Step 512, the bedclothes 400 dress the hexagonal bed structure 100.

A number of embodiments of the invention have been described. Nevertheless, it will be understood that various modifications may be made without departing from the spirit and scope of the invention. Accordingly, other embodiments are within the scope of the following claims.

What is claimed is:

1. A hexagonal bed structure, comprising:

a hexagonal support structure configured to support a mattress for sleeping;

a bed structure that is hexagonal;

a plurality of static furniture pieces affixed to the hexagonal support structure the static furniture pieces including a headboard, a left diagonal side panel, a right diagonal side panel, and a foot-end panel, wherein forward portion of the left diagonal side panel and the right diagonal side panel define open cavity storage spaces;

hardware affixed to the hexagonal bed structure and configure to guide attachments along a path parallel to the bedroom flooring;

dynamic furniture pieces comprising at least one left bedside component and at least one right bedside component with both the left bed component and right bedside component affixed to the hardware and configured to slide horizontally in and out of the open cavity storage spaces; and wherein the dynamic furniture pieces substantially reside within the open cavity storage space when the hexagonal bed structure is in a closed configuration, such that the hexagonal bed structure maintain the same usable square footage of the room when no dynamic furniture pieces are present.

2. The hexagonal bed structure of claim 1, wherein the hexagonal bed structure further comprises a bottom surface and a top surface of the support structure, wherein the bottom surface and the top surface are hexagonal.

3. The hexagonal bed structure of claim 1, wherein the static furniture pieces comprise a headboard positioned at one hexagonal side, a left diagonal side panel, a right diagonal side panel, where the left diagonal side panel and the right diagonal side panel positioned at adjacent hexagonal side, and a foot end panel positioned opposite the headboard.

4. The hexagonal bed structure of claim 1, wherein the dynamic furniture pieces comprise at least one left bedside component and the at least one right bedside component configured to slide horizontally along a path.

5. The hexagonal bed structure of claim 1, wherein the hexagonal bed structure further comprise a plurality of bedclothes, the bedclothes further comprising at least one mattress protector, a mattress pad, a fitted sheet, a flat sheet, and a bed cover to substantially fit, dress or make up the hexagonal bed structure.

6. The hexagonal bed structure of claim 1, wherein the left and the right sides of the hexagonal bed structure are configured to enable interchangeability of static furniture pieces.

7. The hexagonal bed structure of claim 1, wherein the hexagonal bed structure further comprises an irregular hexagonal mattress configured to fit the hexagonal support structure, and bedclothes specifically designed to fit the irregular hexagonal mattress.

8. The hexagonal bed structure of claim 1, wherein the open cavity storage spaces are positioned in forward portions of the diagonal side panels.

9. The hexagonal bed structure of claim 1, wherein the hardware comprises at least one of slide-tracks, rails, or guiding elements that position and stabilize the dynamic furniture pieces during movement.

10. The hexagonal bed structure of claim 1, wherein the dynamic furniture pieces are configured to rotate about a hinge connected within the storage space as an alternative movement mechanism.

11. A method of assembling the hexagonal bed structure of claim 1, comprising:

positioning the hexagonal support structure;

affixing the static furniture pieces to the support structure using fasteners;

installing hardware to guide the dynamic furniture pieces;

attaching the dynamic furniture pieces to the hardware; and installing a mattress on top surfaces of the support structure and static furniture pieces.

12. The hexagonal bed structure of claim 1, wherein the fasteners comprise joiners and screws connecting the static furniture pieces to each other and to the support structure.

* * * * *